US008518224B2

(12) United States Patent
Ma et al.

(10) Patent No.: US 8,518,224 B2
(45) Date of Patent: Aug. 27, 2013

(54) PLATING APPARATUS FOR METALLIZATION ON SEMICONDUCTOR WORKPIECE

(75) Inventors: Yue Ma, Shanghai (CN); Xi Wang, Shanghai (CN); Yunwen Huang, Shanghai (CN); Zhenxu Pang, Shanghai (CN); Voha Nuch, Shanghai (CN); David Wang, Shanghai (CN)

(73) Assignee: ACM Research (Shanghai) Inc. (CN)

( * ) Notice: Subject to any disclaimer, the term of this patent is extended or adjusted under 35 U.S.C. 154(b) by 541 days.

(21) Appl. No.: 12/734,438

(22) PCT Filed: Nov. 2, 2007

(86) PCT No.: PCT/CN2007/071008

§ 371 (c)(1),
(2), (4) Date: Aug. 9, 2010

(87) PCT Pub. No.: WO2009/055992

PCT Pub. Date: May 7, 2009

(65) Prior Publication Data

US 2010/0307913 A1 Dec. 9, 2010

(51) Int. Cl.

| | |
|---|---|
| ***C25D 17/00*** | (2006.01) |
| ***C25D 17/02*** | (2006.01) |
| ***C25D 21/04*** | (2006.01) |
| *C25D 7/12* | (2006.01) |

(52) U.S. Cl.

USPC ..... 204/230.7; 204/260; 204/266; 204/272; 204/278; 205/96; 205/157

(58) Field of Classification Search

USPC ..... 96/179

See application file for complete search history.

(56) References Cited

U.S. PATENT DOCUMENTS

| | | | | |
|---|---|---|---|---|
| 2,731,108 | A * | 1/1956 | Kennedy | 55/521 |
| 2,731,180 | A * | 1/1956 | Fricker et al. | 224/103 |
| 6,368,475 | B1 * | 4/2002 | Hanson et al. | 204/275.1 |
| 6,440,295 | B1 * | 8/2002 | Wang | 205/640 |
| 6,527,920 | B1 | 3/2003 | Mayer et al. | |
| 6,890,416 | B1 | 5/2005 | Mayer et al. | |
| 2004/0159550 | A1 | 8/2004 | Yoshioka et al. | |

FOREIGN PATENT DOCUMENTS

| | | |
|---|---|---|
| CN | 1816650 A | 8/2006 |
| CN | 1961099 A | 5/2007 |

OTHER PUBLICATIONS

Translation of International Preliminary Report on Patentability.

* cited by examiner

*Primary Examiner* — Harry D Wilkins, III

(74) *Attorney, Agent, or Firm* — Howard C. Miskin; Gloria Tsui-Yip

(57) ABSTRACT

The present invention provides a plating apparatus with multiple anode zones and cathode zones. The electrolyte flow field within each zone is controlled individually with independent flow control devices. A gas bubble collector whose surface is made into pleated channels is implemented for gas removal by collecting small bubbles, coalescing them, and releasing the residual gas. A buffer zone built within the gas bubble collector further allows unstable microscopic bubbles to dissolve.

33 Claims, 19 Drawing Sheets

PLATING APPARATUS FOR METALLIZATION ON SEMICONDUCTOR WORKPIECE

FIELD

The present invention generally relates to plating apparatus, more particularly, relates to an apparatus for electrochemically preparing a metallic layer on a thin resistive substrate as part of interconnect formation in ULSI (Ultra large scale integrated) circuit fabrication on wafers.

BACKGROUND

Electrochemical deposition of a metallic layer, usually copper, on a thin resistive substrate—a seed layer—during interconnection formation in ULSI is realized in a plating apparatus consisting of the following components: anodes, power supply, conductive wafer holding device, and an electrolyte cell containing a solution mixture of acid, metal salts and other additives.

In conventional plating, current density across the seed layer is non-uniform, higher at substrate periphery due to a phenomenon called "terminal effect". This current non-uniformity results in higher plating rate at wafer edge and lower plating rate at wafer center.

The plated film non-uniformity due to plating rate difference between wafer edge and center raises difficulty for the subsequent planarization step in the device process flow. A system of anodes with independent power controls is applied to plating apparatus to overcome the non-uniform plating rate, see U.S. Pat. No. 6,391,166.

Gas bubbles are generated during plating with an inert anode or inert anodes. They may also be introduced from electrolyte feed system and during intervention and routine maintenance done to the apparatus. When these bubbles are in contact with the plating surface of the wafer, voids form in plated film, and the device yield drops. In the most severe case, when a large amount of bubbles are present in the electrolyte, the electrical field can be altered and electrolyte flow in the plating apparatus suffers significant drop due to blockage of the flow path.

De-bubble device based on the idea of buoyancy and natural convection is commonly found in modern plating apparatus. These devices usually do not work as well with small bubbles. Once attached to a surface, small bubbles can hardly be moved by the resultant force from balancing buoyancy force, adhesion force, and drag force under a typical flow rate found in these plating apparatus. These devices consist of a porous layer shaped as an inverted cone with a flat surface. To remove small bubbles in large quantity without altering the flow and electrical fields, a bubble coalescence mechanism, to make small bubbles grow large, and more membrane surface area of the de-bubble device are needed.

As the feature size becomes small, a larger amount of organic additives in the plating solution is required to achieve void-free gapfill. These organic components break down during electroplating process. The resultant break-down products accumulate in the plating bath and degrade gapfill performance. If incorporated into plated film as impurities, they may act as nuclei for void formation, causing device reliability failure.

A higher plating bath bleed and feed rate is usually implemented at high cost for more advanced plating process technologies to ensure chemical freshness.

During plating, fresh active organic species and breakdown byproducts exchange rate in the electrolyte near wafer surface, which is mass transport controlled, is not uniform if the flow field in a plating apparatus is not specifically designed. This problem, however, cannot be addressed by a simple rise of bath bleed and feed rate.

SUMMARY

Embodiments of this invention is a plating apparatus that comprises an anode chamber housing at least two anodes, a cathode chamber housing at least two fluid zones, at least two anode circulations, at least two cathode circulations, a buffer zone, a gas bubble collector (by forced bubbles coalescence), a power supply subsystem, an electrolyte flow field control subsystem designed to efficiently removal plating byproducts, an electrolyte distribution subsystem, and a wafer holder device.

The bubble collector assembly consists of at least one porous membrane whose surface is shaped into pleated channels to collect gas bubbles and force them to coalescence there. The cross sections of a pleated channel have the shapes of V or inverted V. Coalesced bubbles are guided to move upwards along the channels or grooves to the exit. The pleated channels further creates a large surface area of the bubble collector therefore increasing total electrolyte flow-through area, allowing electrolyte flow even when the small bubbles partly block the pores of the bubble collector.

Embodiments of the invention further provide an additional buffer zone between membranes, where electrolyte circulation rate is significantly lower than that in the cathode chamber. The buffer zone allows time for micro bubbles that passed the bottom membrane to dissolve before reaching the top membrane.

The present invention includes a method to efficiently supply organic additives to and remove byproducts from the plating substrate surface through controlling the electrolyte flow field near the wafer surface. Electrolyte flow field control is by applying a combination of flow rates and start-stop times in the fluid zones in the cathode chamber. The electrolyte flow field control subsystem controls the flow rate and start-stop time independently in each of the fluid zones. Efficient supply of organic additives improves metal gapfill into via, trench, and dual damascene features of on the substrate, and efficient removal of the plating byproducts reduces the impurity level in the plated metal film.

DETAILED DESCRIPTION OF EMBODIMENTS

Figure 1A:
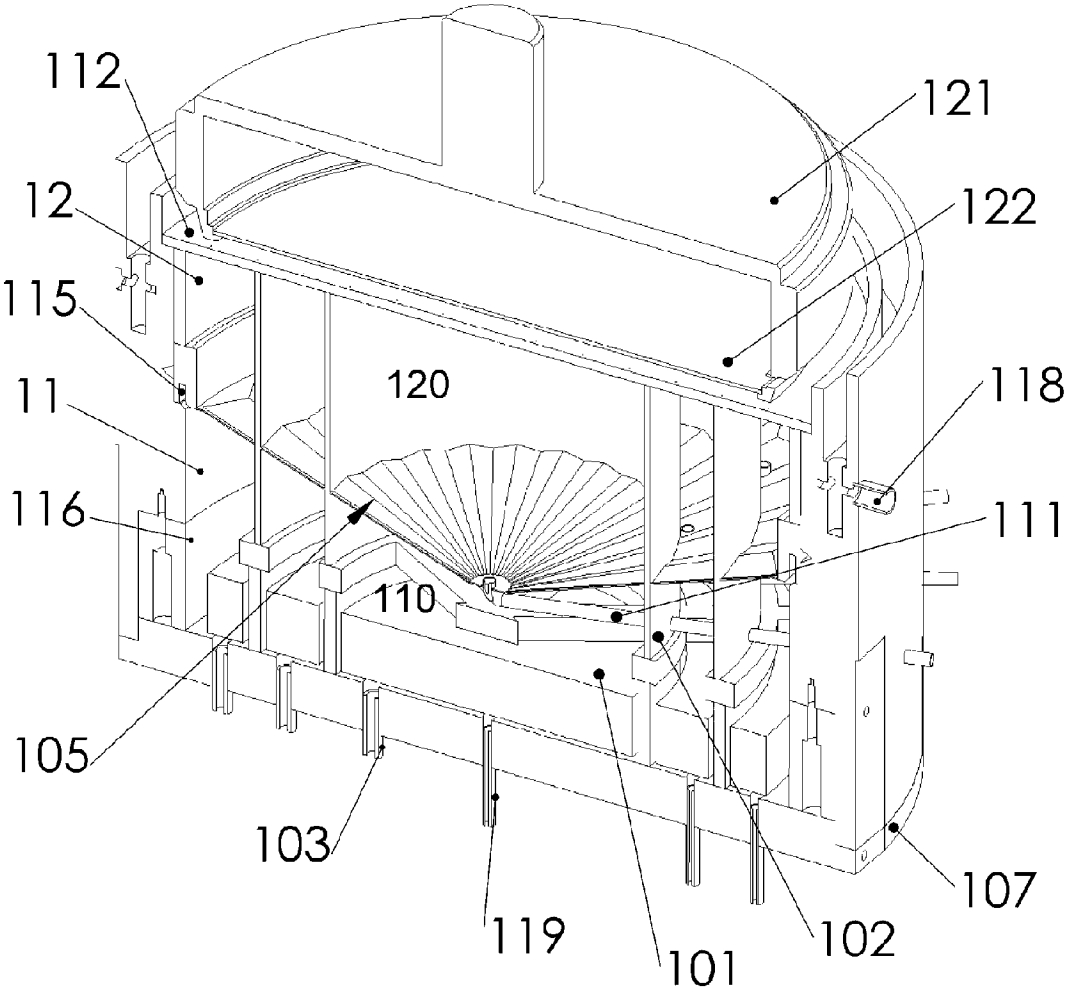
FIG. 1*a* shows a section view of a plating apparatus according to an embodiment of the present invention.
Figure 1B:
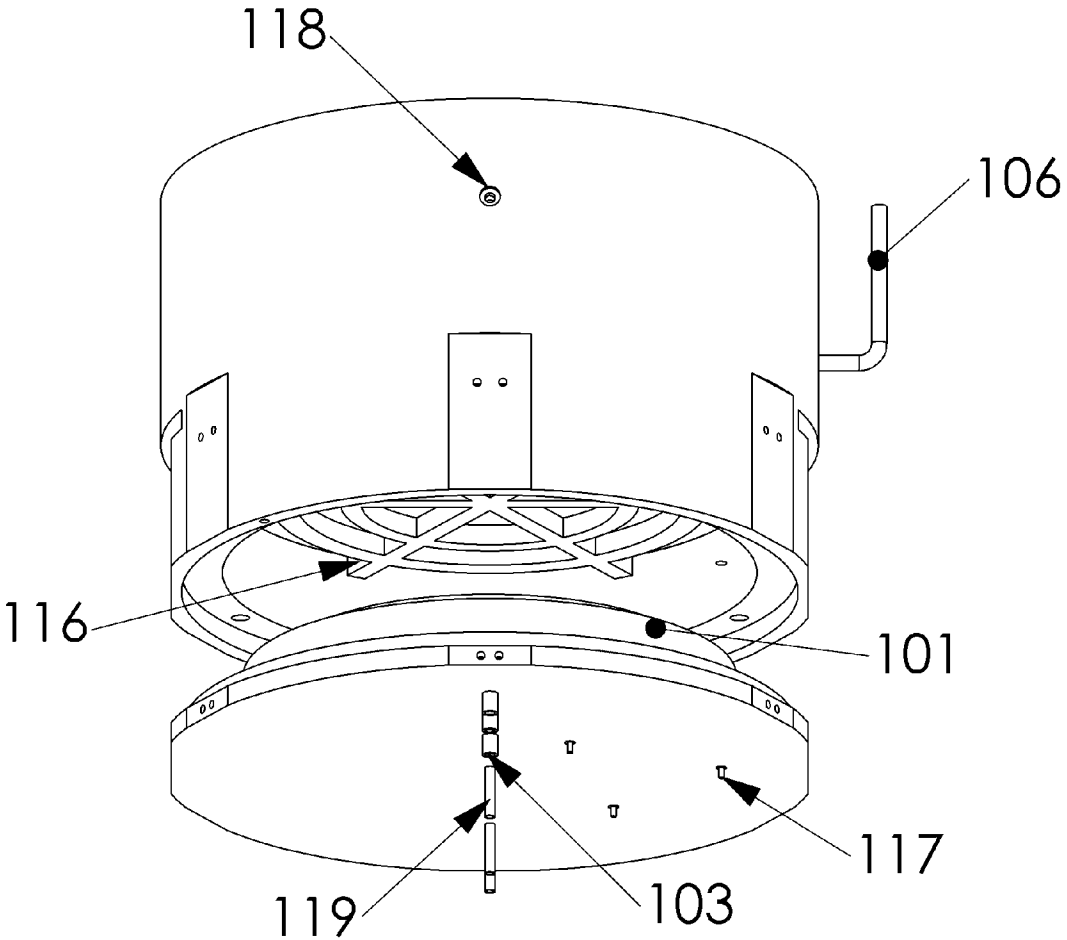
FIG. 1*b* shows an exploded view of the plating apparatus as shown in FIG. 1*a*, wherein the substrate and its holder are omitted.
Figure 1C:
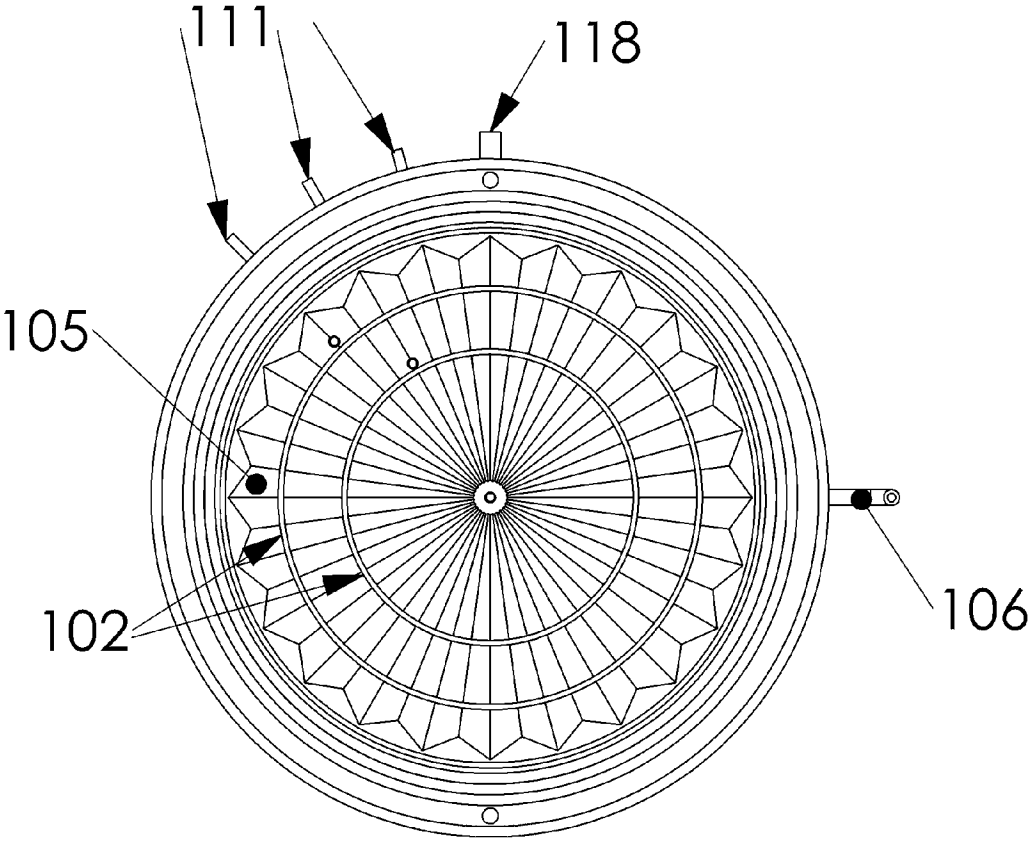
FIG. 1*c* shows a top view of the same plating apparatus without the flow dispersing device, the substrate and its holder.
Figure 2:
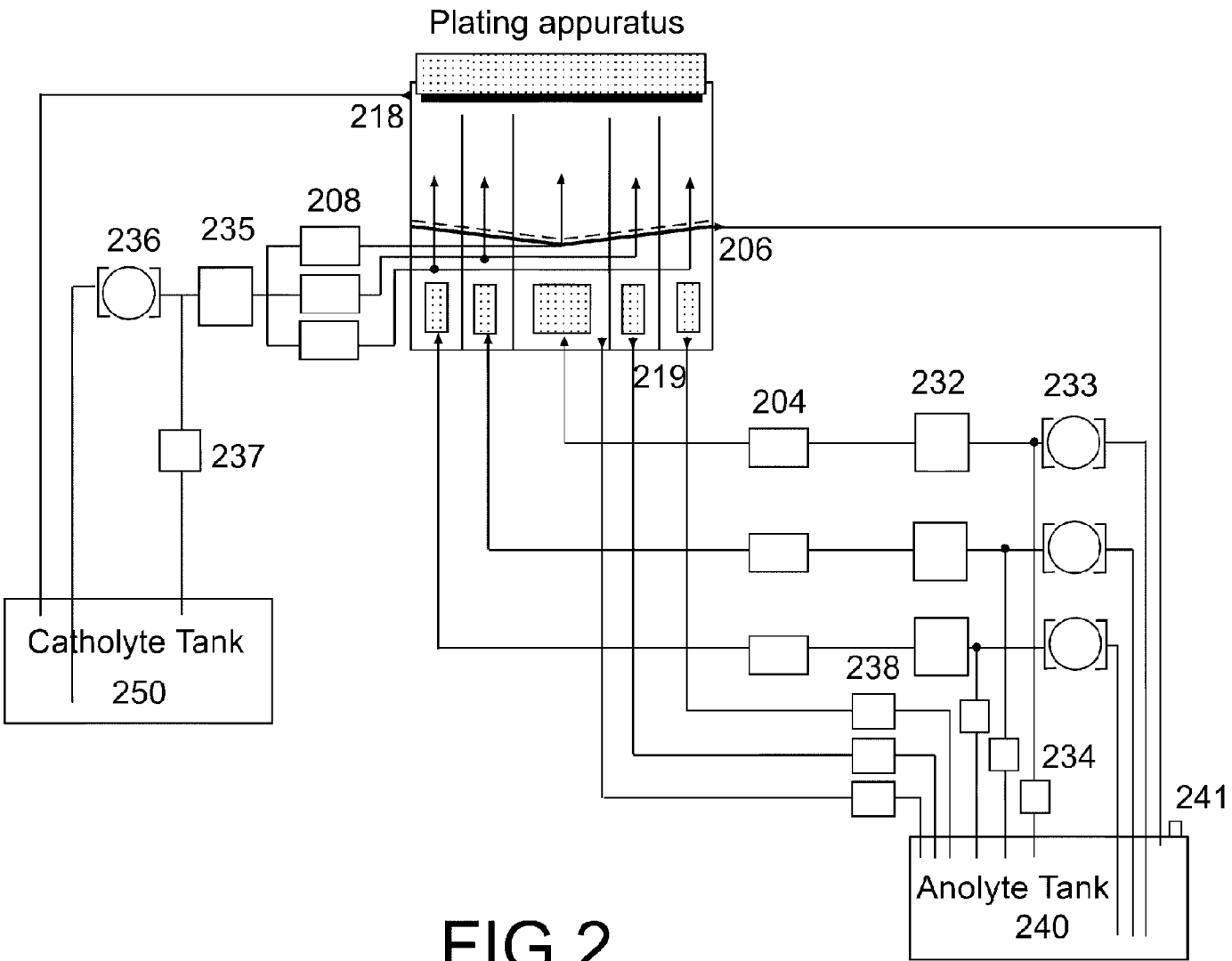
FIG. 2 shows a schematic view of the electrolyte circulations of the plating apparatus.

FIGS. 1*a*, 1*b* and 1*c* show a plating apparatus according to an embodiment of the present invention. The plating apparatus comprises: a lower chamber 11, which houses anodes and consists of multiple anode zones 110, and an upper chamber 12, which consists of multiple cathode zones 120 with separated cathode electrolyte inlets 111. Both anode zones 110 and cathode zones 120 are separated by a plurality of vertically arranged insulation shields 102. The lower chamber 11 and the upper chamber 12 are connected by a horizontally arranged gas bubble collector 105.

In each anode zone 110 of the lower chamber 11, an annular anode 101 is supported by a chamber base 107 and connected to an independently-controlled power supply channel 117. The chamber base 107 has a plurality of keyed conductive struts coated with nonconductive materials to position the anodes. The bottom of the apparatus can be disassembled for anode replacement. A rigid frame 116 above the anodes provides mechanical support for the bubble collector and the upper assembly in the apparatus. Each annular anode 101 is one piece or connected multiple pieces. The power supply of the plating apparatus comprises a plurality of power supply channels 117. According to an embodiment, the lower chamber comprises at least two anode zones 110. The insulation shield 102 surrounds each annular anode 101 and separates the electric fields and restricts the electrolyte flow fields. The materials of the insulation shields 102 are selected from nonconductive, chemically resistive plastics. According to one embodiment, the insulation shields 102 have a plurality of small openings that serve as passages near the bubble collector 105 for the gas bubbles. According to another embodiment, the insulation shields 102 have no small openings to fully isolate the electrolyte in adjacent anode zones.

Plating current or potential is supplied independently to each of the annular anode by the power supply channels 117. Potential and waveforms applied to each of the annular anode is from an independent power supply channels of power supply at programmed times. The power supplies can be the DC or pulse power supplies.

An anode flow distribution sub-system consisting of independent anode electrolyte inlet 103 connected to an electrolyte flow control device and independent anode electrolyte outlet 119 in each anode zone is employed to supply electrolyte to and discharge aged electrolyte, build-ups, and particles from each anode zone. The independent anode electrolyte circulation in each anode zone minimizes mixing of anode electrolyte flows from different anode zones.

A gas bubble collector 105 is made of one or more permeable membranes attached to a rigid perforated or meshed frame, wherein the frame is cone-shaped or inverted cone-shaped. A groove 115 at the periphery of gas bubble collector frame collects the bubbles and guides them to a gas outlet 106. The groove 115 can be tilted to form an angle in respect to the horizontal plane. A gas outlet 106 is connected to groove for the collected gas to exit.

One or more attached permeable membranes 302 (in FIG. 3*a*) are designed to implement different functions. The lower membrane functions as a barrier to gas bubbles whose diameter is larger than a few microns to a few tens of microns. It also prevents build-up materials in the lower chamber to enter the electrolyte above it and provides the mechanical support for the upper membranes. According to an embodiment, the bubble collector membrane is made from a group of porous fluorine plastics, such as polyvinyl fluoride (PVF), polyvylidene difluoride (PVDF), polytetrafluoroethylene (PTFE), perfluoroalkoxy alkane (PFA), with average pore size ranging from 2 μm to 50 μm. In another embodiment, the upper membrane functions as a barrier to micro gas bubbles whose diameter is less than 2 micron. This membrane allows specific ions while prohibits large molecules to pass through it. According an embodiment, the upper membrane is made of one of said group of fluorine plastics, with specific functional groups, and the average pore size is between 2 nm and 150 nm.

The surface of the permeable membranes has pleated channels to improve bubble collecting effectiveness and enlarge gross surface area of the permeable membranes. The pleated channels have v-shaped or inverted v-shaped cross-sections. Such a configuration forces bubbles to coalesce into the channels first before guiding the residual gas to move upwards along the channels to the exit. According to an embodiment, the pleated channels can be radially arranged, spirally arranged or annularly arranged, and the angle between the two adjacent side walls of the pleated channels is between 10° to 120°. The maximum height of each pleated channel is between 2 mm and 30 mm.

The total body force acting on a bubble (when gravity is omitted) in a stagnant electrolyte solution is given in (1), and it is strongly related to the bubble radius:

$$F = \frac{4}{3}\pi g \rho r^3 - 6\pi\eta v r \tag{1}$$

wherein F is the total body force, r is the bubble's radius, v is the bubble's velocity, η is the viscosity of electrolyte solution.

A bubble with small radius is difficult to move in an electrolyte solution due to the small total body force. For them to be effectively removed from the electrolyte, they need to coalesce and form larger bubbles. The pleated channels force the bubble travel paths to converge at the bottom of the channels, where the bubbles coalesce and grow. Once growing in size, larger body force moves them upwards along the channels towards the exit.

Moreover, decreasing the angle between two adjacent side walls of the pleated channels reduces the resistance against the buoyancy effect on bubbles in contact with the side walls, easier for them to travel to the bottom of the pleated channels.

According to another aspect, the pleated channels further increase the surface area of membranes, so that the total electrolyte flow-through area of membranes increases. A larger surface area allows sufficient electrolyte to flow through even in the presence of small bubbles that may attach to the membrane and partly block the pores. A larger surface area also increases its effectiveness for specific ions filtering.

In to FIGS. 1*a* and 1*b*, according to an embodiment, the upper chamber 12 consists of a plurality of cathode zones 120 whose cross-sections are annular in shape except the central cathode zone, which is circular. Each cathode zone 120 in the upper chamber 12 consists of at least one independently-fed electrolyte inlet 111 connected to electrolyte flow control device. Excess electrolyte exits the upper chamber at the perimeter of upper chamber body and drains out from an outlet 118. The pipelines of electrolyte inlets 111 go through bubble collector frame and the insulation shields 102 to reach each individual cathode zone 120. The electrolyte flow control devices of the cathode zones can be programmed to vary flow rates and on-off times so that the streamlines of the flow field are manipulated globally or locally at a specific process step.

Local flow field control is needed to maintain freshness of electrolyte mixture in regions near the plating surface, especially for the organic additive molecules in the mixture. The concentrations of organic additives affect the plating rate, gapfill capability, and the defectivity in the resultant film. Local flow field control is also needed to remove byproducts from plating reaction region effectively, preventing them from being incorporated into the growing metallic film. By removing byproducts from the reacting region near the reacting surface, plating gapfill imperfections in via and trench features are minimized and the reliability of the final metallic lines and contacts is improved. The electrolyte flow control device can be adjusted to result in a uniform flow field across plating substrate, which ensures equal exchange rate between fresh organic additives and reaction byproducts in regions near the center and near the edge of the plating substrate. The equal change rate between fresh organic additives and reaction byproducts across the plating substrate ensures compositional uniformity in the final plated film, which, in turn, improves the final electrical resistivity uniformity and electromigration performance uniformity among the devices fabricated at different locations on the substrate.

As a conclusion, by controlling flow field locally, the following effects can be obtained: controlling the thickness uniformity of the plated film across the substrate; controlling the composition uniformity of the plated film across the substrate; controlling the electrical resistivity uniformity of the plated film across the substrate; controlling the uniformity of electromigration resistance in the plated film across the substrate.

The upper portion of upper chamber 12 further consists of a fluid dispersing device 112 in close proximity to the substrate to generate a microscopically uniform flow field at the top of each cathode zone. According to an embodiment, the flow dispersing device 112 is made of one of the following: porous ceramic and chemically-resistive plastic materials.

A substrate holder 121 located above the upper chamber 12 holds the substrate 122 and conducts electrical current to it. For a detailed description of a substrate holder, see U.S. Pat. No. 6,248,222, U.S. Pat. No. 6,726,823 and U.S. Pat. No. 6,749,728, the entire content of which are incorporated herein by reference.

Electrolyte solution from anode electrolyte tank 240 is supplied to each anode zone at a set of flow rates. Before reaching each anode zone, the electrolyte solution passes a pump 233, a filter 232, and a flow control device 204. The electrolyte from each anode zone returns to anode electrolyte tank 240 though an outlet 219 located at the bottom of the lower chamber. The return electrolyte solution is regulated by a liquid mass flow controller 238. The collected gas in lower chamber exits out of the lower chamber from the gas outlet 206 to anode electrolyte tank 240, where gas leaves to exhaust 241. A pressure leak valve 234 is located between filter 232 and anode electrolyte tank 240. Separate Electrolyte solution from cathode electrolyte tank 250 is supplied to each cathode zone at a set of flow rates. Before reaching the cathode zone, the electrolyte solution passes a pump 236, a filter 235, and a flow control device 208. The electrolyte from each cathode zone returns to cathode electrolyte tank 250 through an outlet 218 located at the sidewall of the upper chamber. A pressure leak valve 237 is located between filter 235 and anode electrolyte tank 250. Pressure leak valves 234 and 237 open when flow controllers 204 and 208 are closed.

Figure 3A:
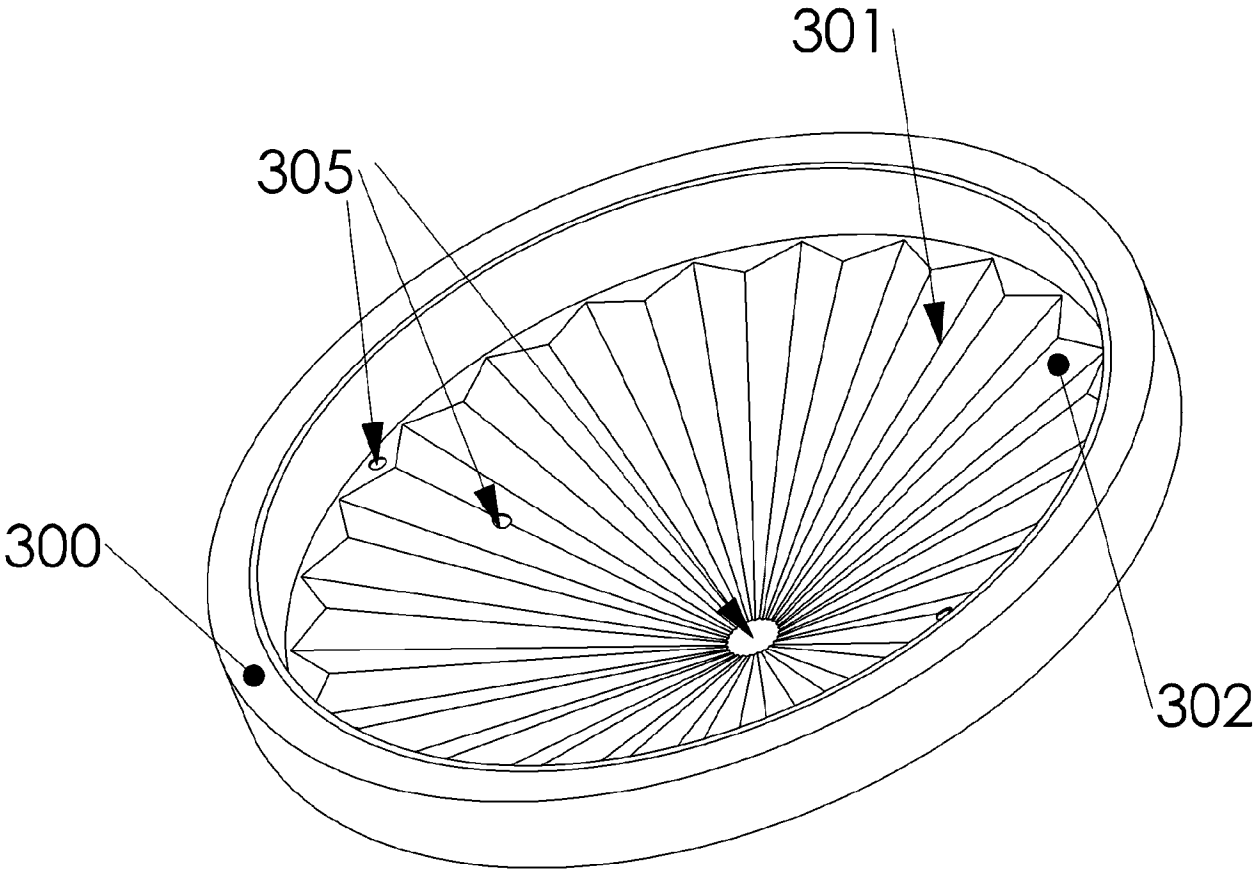
FIG. 3*a* shows an isometric view of the gas bubble collector of the first embodiment.
Figure 3B:
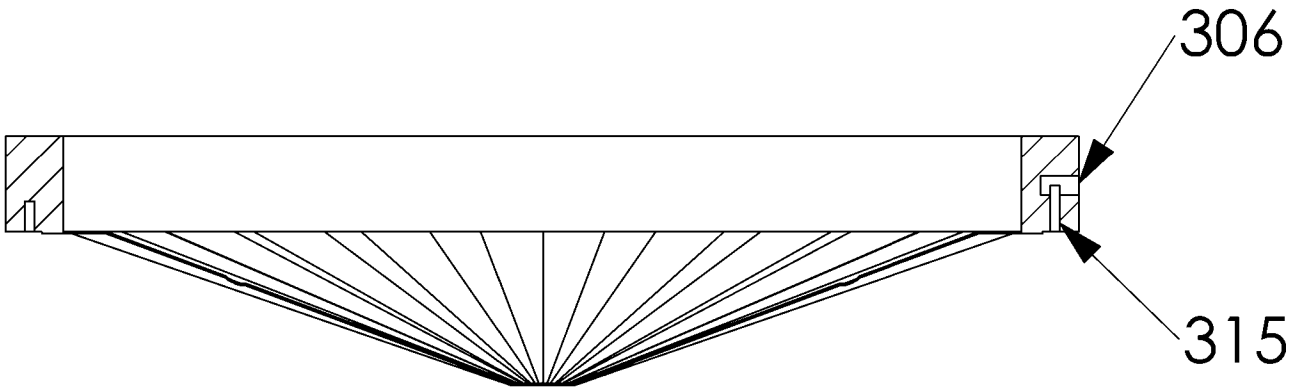
FIG. 3*b* shows a cross-section of the gas bubble collector of FIG. 2*a;*
Figure 3C:
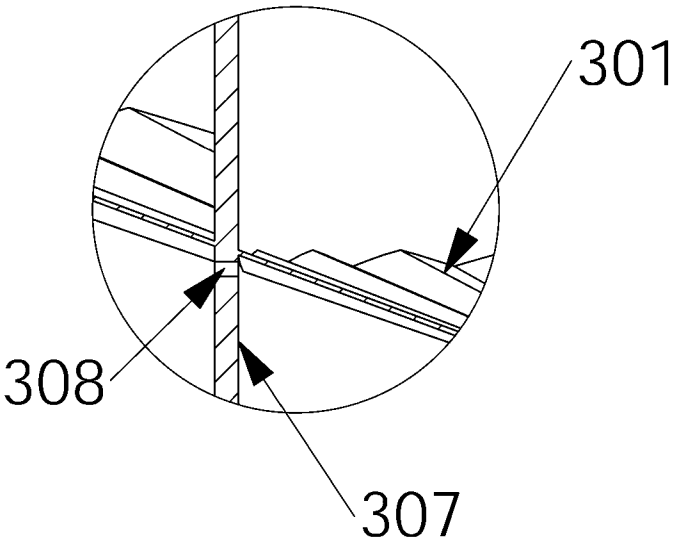
FIG. 3*c* shows a detailed view of the portion of gas bubble collector connected to the insulation shields.

FIGS. 3*a*, 3*b* and 3*c* show the first embodiment of the gas bubble collector, wherein FIG. 3*a* shows an isometric view of the gas bubble collector, FIG. 3*b* shows its cross-section, and FIG. 3*c* shows a detailed view of the gas bubble collector assembled together with the insulation shields.

As shown in FIGS. 3*a* and 3*b*, a plurality of radially pleated channels 301 is located on a cone-shaped or inverted cone-shaped frame 300. The radially pleated channels 301 have V-shaped cross-sections as mentioned previously. Electrolyte solution enters into upper chamber through a plurality of openings 305 located on frame 300.

The coalesced gas bubbles move upwards along the radially pleated channels, passing through small openings 308 on the insulation shields 307, as shown in FIG. 3*c*. According to an embodiment with the inverted cone-shaped frame, the up-moving coalesced gas bubbles are eventually collected by a groove 315 at the periphery of gas bubble collector. The groove 315 connects to a gas outlet 306 where the collected gas exits. The groove and the gas outlet are omitted from embodiments for the simplicity in the following drawings. According to an embodiment with the cone-shaped frame, the gas bubbles are collected in the apex of the conical bubble collector, and gas outlet tubes are positioned slightly below the highest points of apex to conduct gas out to anode electrolyte tank.

Figure 4A:
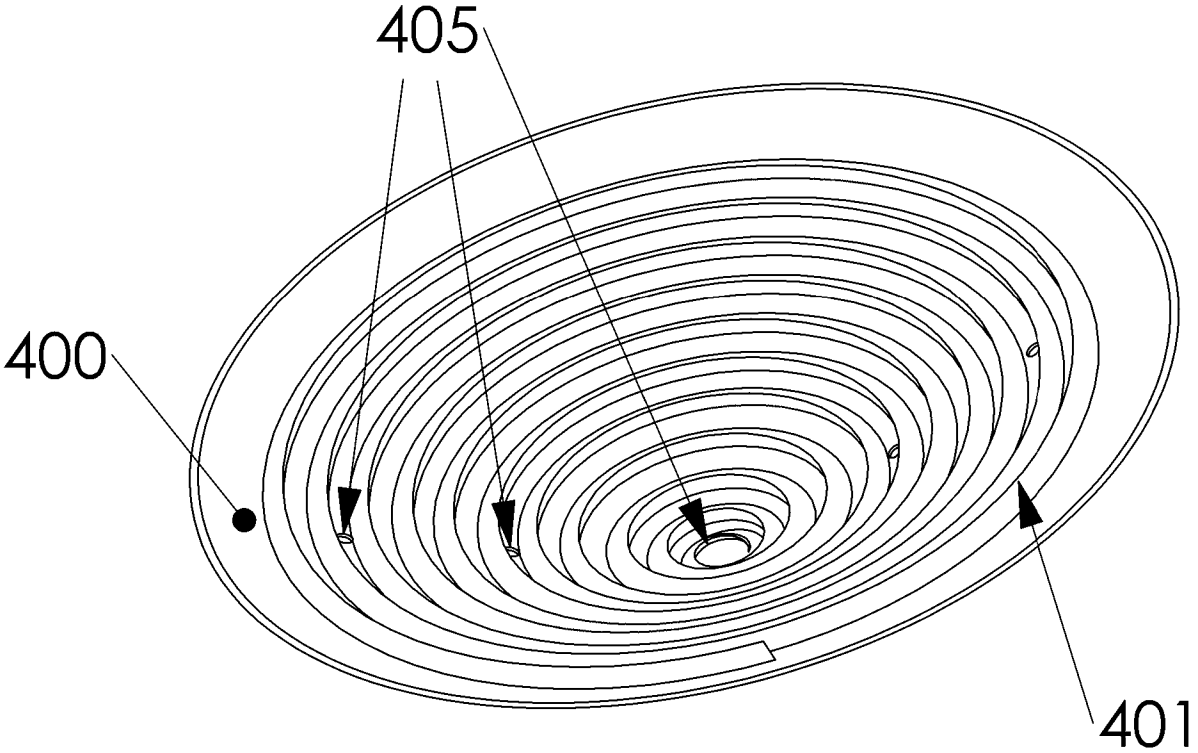
FIG. 4*a* shows an isometric view of a gas bubble collector of the second embodiment.
Figure 4B:
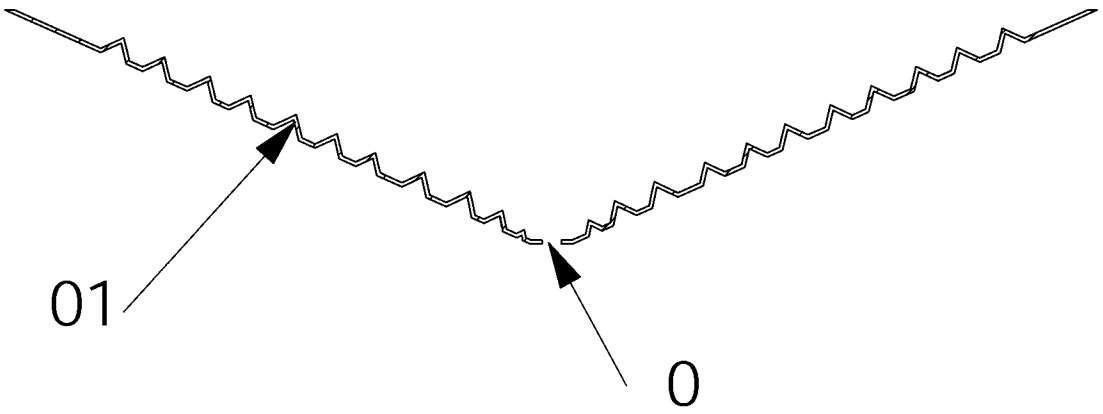
FIG. 4*b* shows a partial cross-section of the gas bubble collector of FIG. 4*a;*
Figure 4C:
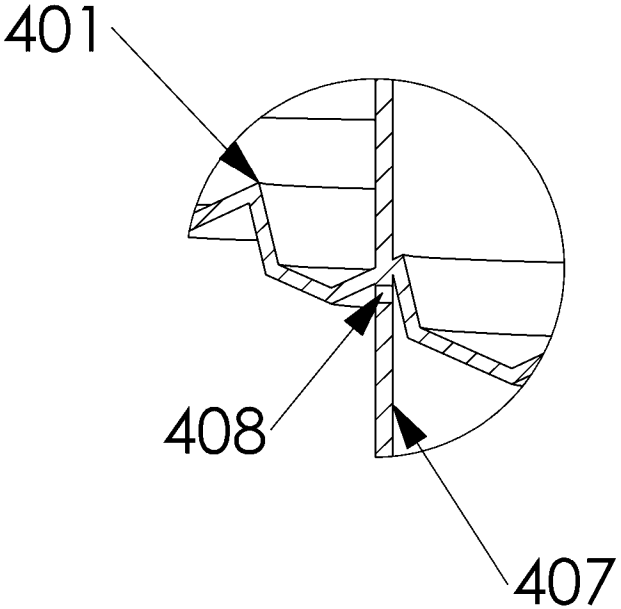
FIG. 4*c* shows a detailed view of the portion of gas bubble collector connected to the insulation shields.

FIGS. 4*a* and 4*b* show the second embodiment of the gas bubble collector, wherein FIG. 4*a* shows an isometric view of the gas bubble collector, FIG. 4*b* shows its partial cross-section, and FIG. 4*c* shows a detailed view of the portion of gas bubble collector connected to the insulation shields.

As shown in FIGS. 4*a* and 4*b*, one spirally pleated channel 401 is located on a cone shaped or inverted cone-shaped frame 400, and the spirally pleated channel of FIGS. 4*a* and 4*b* is continuous and goes through the whole surface of the frame. The spirally pleated channel 401 can have the same cross section shape as the radially pleated channels mentioned above. A plurality of openings 405 are for passing electrolyte solutions.

The coalesced gas bubbles goes upwards along the spirally pleated channel, passing through small openings 408 on the insulation shields 407, as shown in FIG. 4*c*. The up-moving gas is collected and conducted out the way similarly to that in the first embodiment.

Figure 5A:
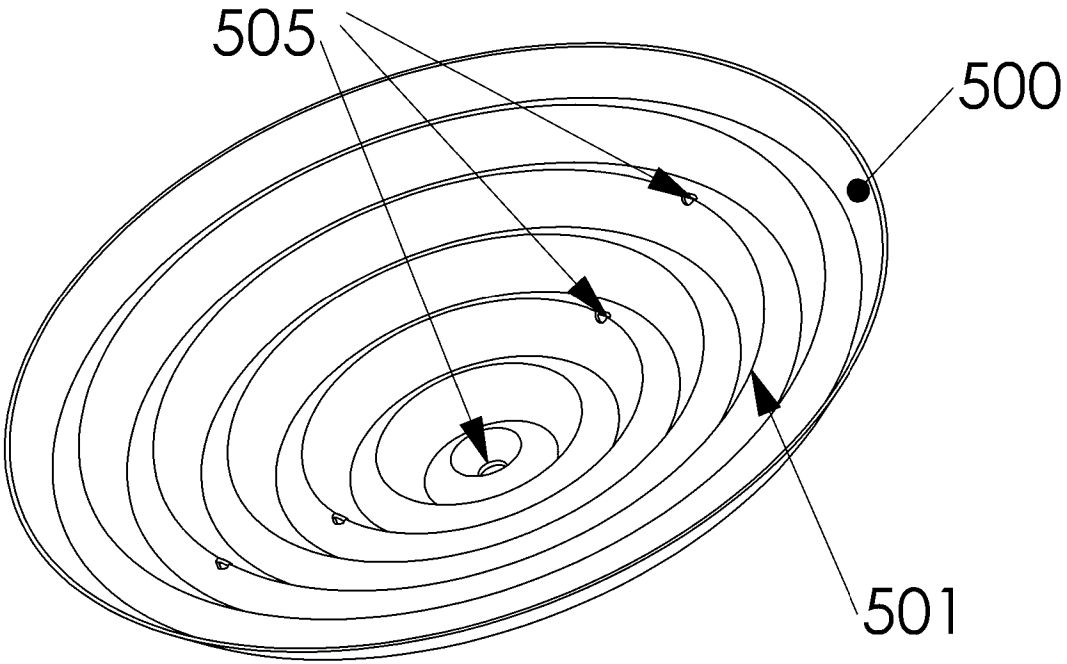
FIG. 5*a* shows an isometric view of a gas bubble collector of the third embodiment.
Figure 5B:
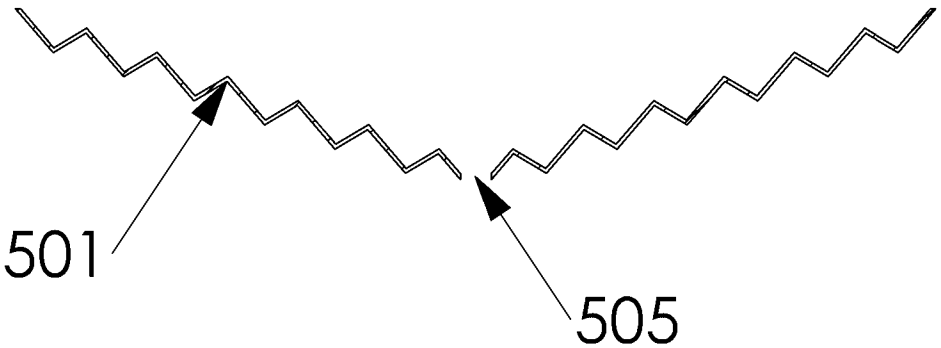
FIG. 5*b* shows a partial cross-section view of the gas bubble collector of FIG. 5*a;*
Figure 5C:
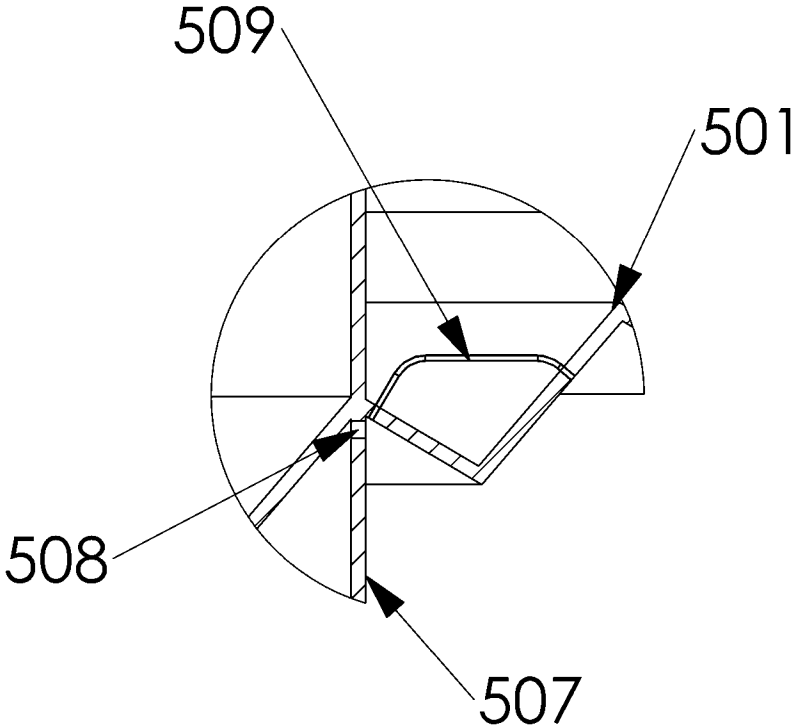
FIG. 5*c* shows a detailed view of the portion of gas bubble collector connected to the insulation shields.

FIGS. 5*a* and 5*b* show the third embodiment of the gas bubble collector, wherein FIG. 5*a* shows an isometric view of the gas bubble collector, FIG. 5*b* shows its partial cross-section, and FIG. 5*c* shows a detailed view of the portion of gas bubble collector connected to the insulation shields.

As shown in FIGS. 5*a* and 5*b*, a plurality of annular pleated channels 501 is located on a cone-shaped or inverted cone-shaped frame 500, and the annular pleated channels of FIGS. 5*a* and 5*b* are arranged at different vertical positions. According to one embodiment, the each annular pleated channel has the same angle between the adjacent side walls. According to another embodiment, different annular pleated channels have different angles between the side walls.

For each annular pleated channel, it has the same cross section shape with the radially pleated channels mentioned above. A plurality of openings 505 are for passing electrolyte solutions.

The coalesced gas bubbles in the lower channels move to the higher channels through paths 509 that connect the adjacent channels and small openings 508 on the insulation shields 507, as shown in FIG. 5*c*. The up-moving gas is collected and conducted out the way similarly to that in the first embodiment.

Figure 6A:
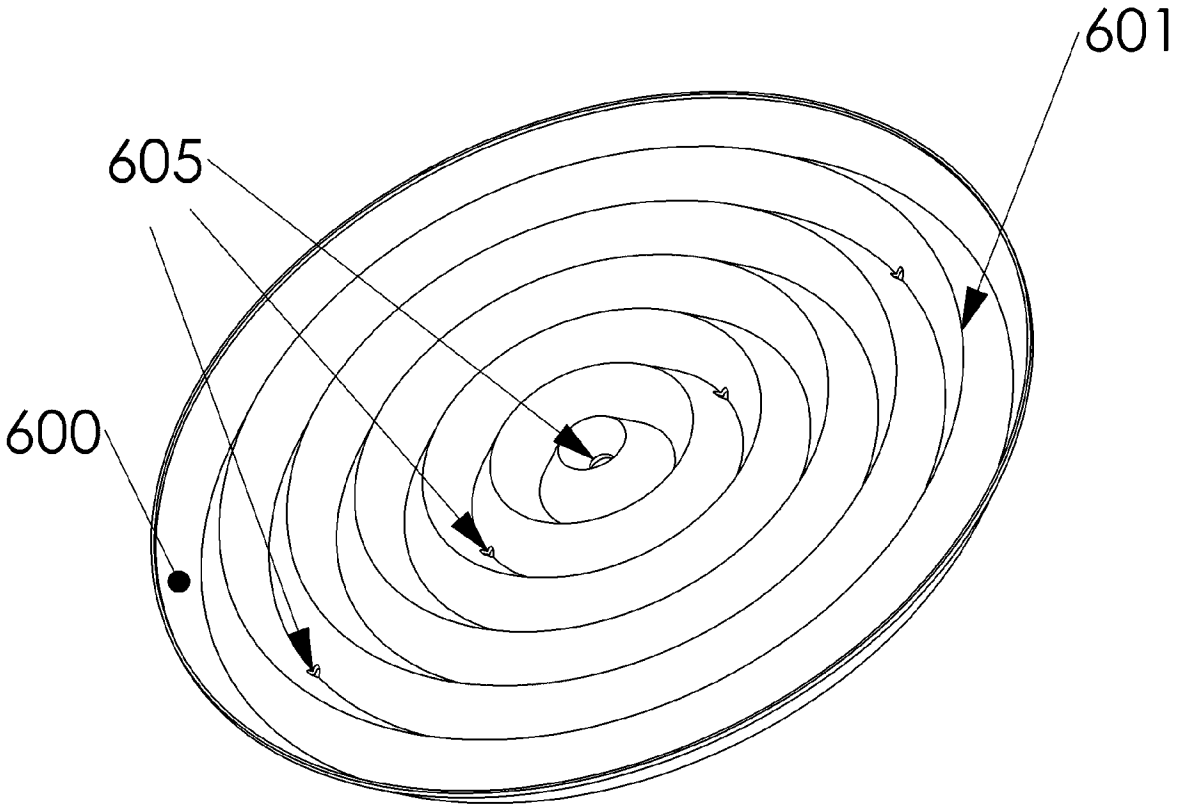
FIG. 6*a* shows an isometric view of a gas bubble collector of the fourth embodiment.
Figure 6B:
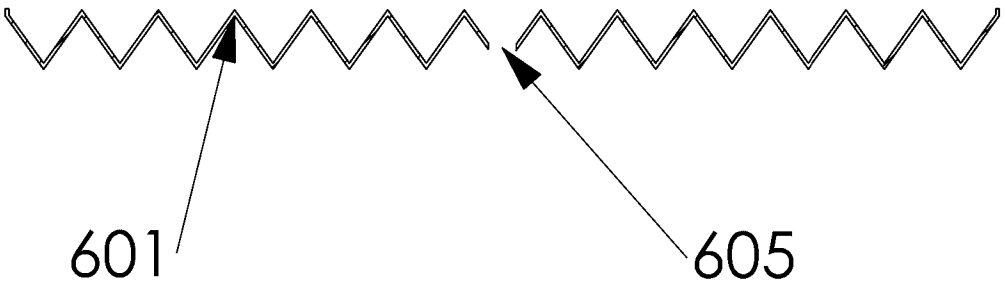
FIG. 6*b* shows a partial cross-section view of the gas bubble collector of FIG. 6*a;*
Figure 6C:
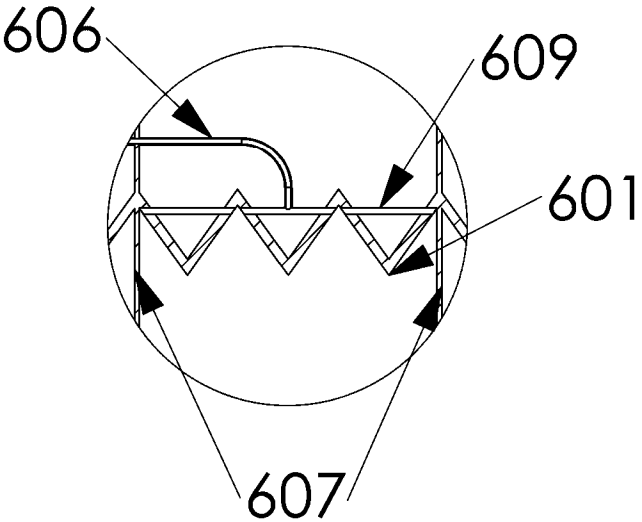
FIG. 6*c* shows a detailed view of the portion of gas bubble collector connected to the insulation shields according to one embodiment.
Figure 6D:
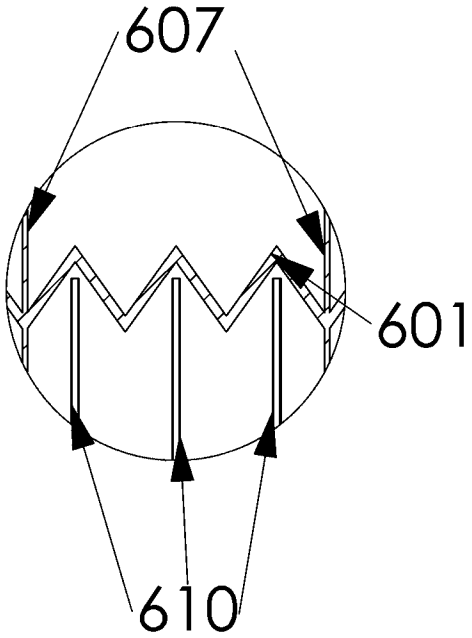
FIG. 6*d* shows a detailed view of the portion of gas bubble collector connected to the insulation shields according to another embodiment.

FIGS. 6*a* and 6*b* show the fourth embodiment of the gas bubble collector, wherein FIG. 6*a* shows an isometric view of the gas bubble collector, FIG. 6*b* shows its partial cross-section, FIGS. 6*c* and 6*d* show the detailed views of the portion of gas bubble collector connected to the insulation shields with two methods to conduct the collected gas out of the channels.

The fourth embodiment is similar to the third embodiment except the annular pleated channels 601 are arranged at the same vertical position on a flat frame 600.

According to one embodiment, each anode zone is fully separate by the insulation shields that have no opening to pass gas so as to prevent intercrossing the anode electrolyte between the adjacent anode zones. Each anode zone consists of an independent gas exit to exhaust the collected gas out of the apparatus. In one embodiment, the coalesced gas bubbles collected in the horizontally arranged pleated channels are conducted through a path 609 connecting the highest portions of the channels with V-shaped cross-section within an isolated zone. The collected gas exits out from a gas outlet tube 606 that connects to path 609 and goes through insulations walls 607 to return to anode electrolyte tank, as shown in FIG. 6*c*. In another embodiment, the coalesced gas bubbles collected in the pleated channels are pressed in the gas outlet tubes 610 below and in close proximity to the highest portions of the channels with V-shaped cross-section by the hydrodynamic pressure of electrolyte flow and returns to anode electrolyte tank, as shown in FIG. 6*d*. In another embodiment, there are only channels with half-V-shaped cross-section between two insulation shields. An insulation shield intersects the lowest portion of a channel with V-shaped cross-section, and the next insulation shield intersects the adjacent highest portion of a channel with V-shaped cross-section. The surface of the bubble collector between two adjacent insulation shields is no longer pleated in this particular configuration, and the bubble collector is suitable to applications that do not require complete removal of microbubbles.

Figure 7:
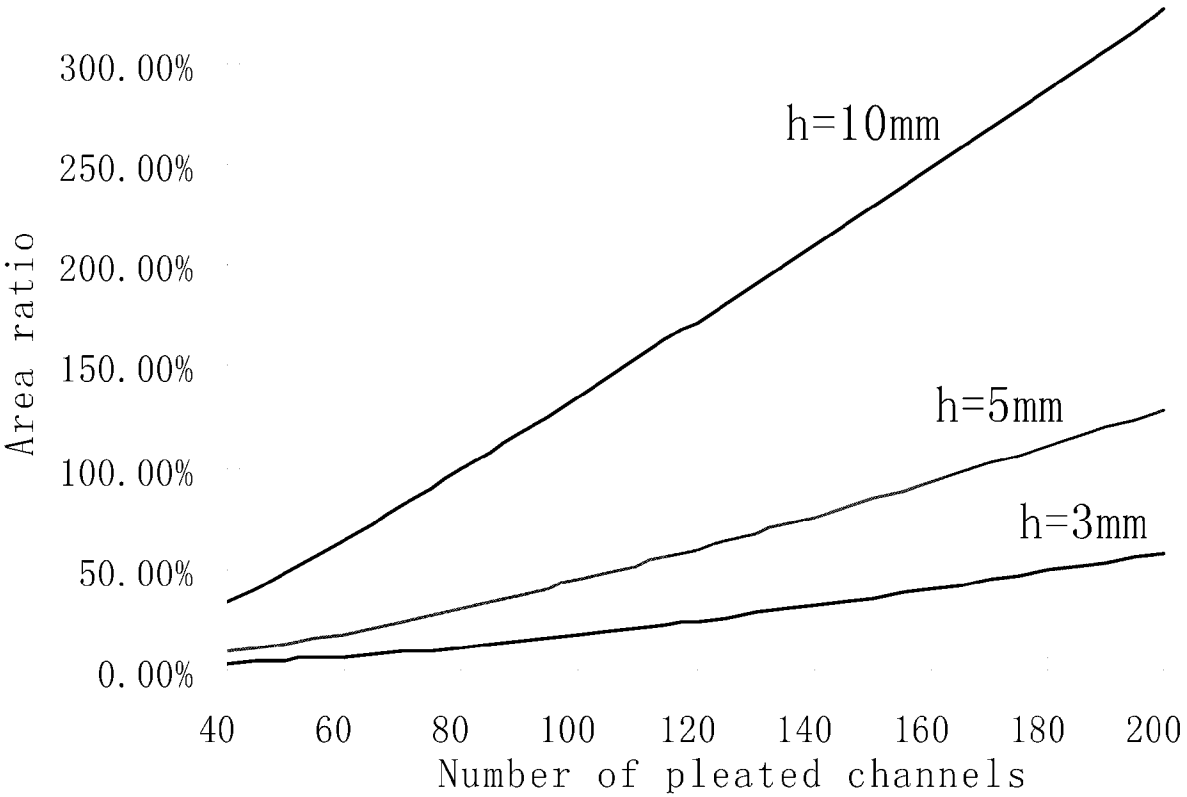
FIG. 7 shows the area ratio as a function of the number of radially-arranged pleated channels at different maximum channel heights.

FIG. 7 shows the ratio of total area of the membrane with radially pleated channels over the area without them. The variables and dimensions used in the calculation are given in Table 1. The total area with radially pleated channels can be calculated from equation (2) derived based on the first embodiment. This ratio increases with increasing number of the channels and maximum channel heights. The higher this ratio is, the larger the area for electrolyte to flow through. As shown, the area tripled with 200 radially pleated channels at a maximum channel height of 10 mm.

TABLE 1

| | |
|---|---|
| Base Radius of Cone | R |
| Height of Cone | H |
| Element of Cone | L |
| Maximum Height of pleated channel | h |
| Number of pleated channels | n |

$$\text{Area} = n\cdot\left(2\sqrt{s\left(s-\sqrt{\left(R\cos\left(\frac{\pi}{n}\right)-\frac{h\sqrt{L^2-R^2\sin^2\left(\frac{\pi}{n}\right)}}{H}\right)^2+H^2}\right)\left(s-\sqrt{\frac{h^2L^2}{H^2}+R^2\sin^2\left(\frac{\pi}{n}\right)\left(1-\frac{h^2}{H^2}\right)}\right)(s-L)}+\frac{R^2\pi}{n}-\left(R\cos\left(\frac{\pi}{n}\right)-\frac{h\sqrt{L^2-R^2\sin^2\left(\frac{\pi}{n}\right)}}{H}\right)R\sin\left(\frac{\pi}{n}\right)\right) \quad (2)$$

$$\text{Where } s=\frac{\left(\sqrt{\left(R\cos\left(\frac{\pi}{n}\right)-\frac{h\sqrt{L^2-R^2\sin^2\left(\frac{\pi}{n}\right)}}{H}\right)+H^2}+\sqrt{\frac{h^2L^2}{H^2}+R^2\sin^2\left(\frac{\pi}{n}\right)\left(1-\frac{h^2}{H^2}\right)}+L\right)}{2}$$

Figure 8:
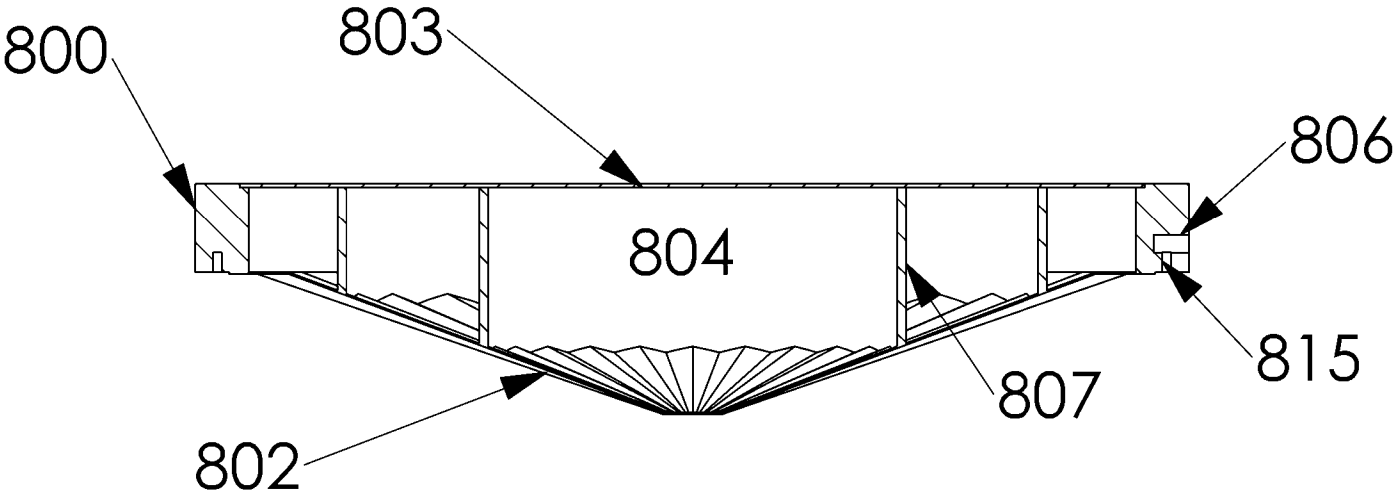
FIG. 8 shows a cross-section of the gas bubble collector of the fifth embodiment.

FIG. 8 shows a cross-section of the fifth embodiment of a gas bubble collector with radial pleated channels and a buffer region between membranes.

As shown in FIG. 8, the gas bubble collector has at least two permeable membranes 802, 803, a buffer region 804 between the permeable membranes, and a frame 800 for supporting the permeable membranes. A plurality of openings as electrolyte inlets is provided in the same way described in the first embodiment, and the coalesced gas bubbles move up and exit the way similarly to that in the first embodiment.

According to the embodiments of FIG. 8, a gap exists between the lower membrane 802 and the upper membrane 803 to form a buffer region. The electrolyte flows slow enough in the buffer region 804 so that most microscopic bubbles that permeate through the lower membrane have time to dissolve in the region due to their unstable nature. It should be noticed that, in the present application, "microbubbles" refers to the gas bubbles smaller than the pore size of the lower membrane. The electrolyte in the buffer region is independently controlled by an additional electrolyte circulation to provide lower hydrodynamic pressure in respect to that in the upper chamber. The pressure difference ensures a downward electrolyte flow that prevents temporal attachment of microscopic bubbles to the membrane, which may act as blockage to ion diffusion through the upper membrane.

The buffer region can be applied to any of the embodiments of the gas bubble collectors introduced above.

What is claimed is:

1. A plating apparatus, comprising:

a lower chamber comprising a plurality of anode zones separated by a plurality of insulation shields; wherein each anode zone forms an anode electrolyte circulation;

an upper chamber comprising a plurality of cathode zones separated by said plurality of insulation shields; wherein the cathode electrolyte circulation within each cathode zone is independently controlled;

a gas bubble collector having pleated channels of v-shaped or inverted v-shaped cross-sections, being placed between the lower chamber and the upper chamber, wherein the gas bubble collector collects bubbles, forces them to coalesce, and guides the coalesced bubble to move out of the apparatus;

a flow dispersing device, being placed at the top of the upper chamber;

a substrate holder, being placed above said flow dispersing device for holding substrate and conducting electrical current to the substrate;

a power supply with a plurality of independently controlled channels;

an electrolyte flow control devices for controlling electrolyte flows within the zones of the chambers;

a plurality of flow distribution sub-system for distributing electrolyte flows into the chambers.

2. The apparatus of claim 1, wherein the gas bubble collector comprising:

one or more frames that supports one or more permeable membranes;

a path for coalesced gas bubbles to move upwards to a gas outlet;

wherein the permeable membrane closest to the lower chamber have pleated channels of v-shaped or inverted v-shaped cross-sections, where gas bubbles are collected and forced to coalesce; and the permeable membrane closest to the upper chamber collects microbubbles that passed the membrane closest to the lower chamber.

3. The apparatus of claim 2, wherein the permeable membrane closest to the lower chamber is made of one of the following materials: polyvinyl fluoride (PVF), polyvylidene difluoride (PVDF), polytetrafluoroethylene (PTFE), perfluoroalkoxy alkane (PFA), and the pore size is between 2 μm to 50 μm, the permeable membrane closest to the lower chamber separates build-up materials in the lower chamber and the electrolyte above it.

4. The apparatus of claim 2, wherein the permeable membrane closest to the upper chamber is made of one of the following materials: polyvinyl fluoride (PVF), polyvylidene difluoride (PVDF), polytetrafluoroethylene (PTFE), perfluoroalkoxy alkane (PFA), and the pore size is between 2 nm to 150 nm, the permeable membrane closest to the upper chamber filters specific ions in the electrolyte.

5. The apparatus of claim 2, wherein the angle between two adjacent side walls of said pleated channel is between 10 and 120 degrees.

6. The apparatus of claim 2, wherein decreasing the angle between two adjacent side walls of the pleated channels reduces the resistance against the buoyancy effect on bubbles in contact with the side walls, moving them into said pleated channels to coalesce there.

7. The apparatus of claim 2, wherein increasing the number of the pleated channels at a given maximum channel height increases the effective surface area of said bubble collector.

8. The apparatus of claim 2, wherein the pleated channels are radially arranged on a cone-shaped or inverted cone-shaped frame.

9. The apparatus of claim 2, wherein the pleated channels are spirally arranged on a cone-shaped or inverted cone-shaped frame.

10. The apparatus of claim 2, wherein the pleated channels are annularly arranged on a cone-shaped or inverted cone-shaped frame.

11. The apparatus of claim 2, wherein the pleated channels are annularly arranged on flat frames at the same vertical position.

12. The apparatus of claim 2, wherein the pleated channels are annularly arranged on flat frames at different vertical positions.

13. The apparatus of claim 1, wherein in each anode zone, an anode is surrounded by one of the insulation shields and is connected to an independently controlled channel of a power supply system.

14. The apparatus of claim 1, wherein the gas bubble collector comprising more than one permeable membrane;

a gap is provided between the membranes to form a buffer region; and electrolyte in the buffer region is controlled independently.

15. The apparatus of claim 1, wherein:

in each cathode zone, at least one independently controlled electrolyte inlet is provided to control its local flow field.

16. The apparatus of claim 15, wherein:

the local flow fields in the plurality of cathode zones are used to control the mass transport and material exchange of reactants and byproducts near the reacting surface of the substrate.

17. The apparatus of claim 15, wherein:

the local flow fields in the plurality of cathode zones are used to control the compositional uniformity of the plated film across the substrate.

18. The apparatus of claim 15, wherein:

the local flow fields in the plurality of cathode zones are used to control the gapfill performance across the substrate.

19. The apparatus of claim 15, wherein:

the local flow fields in the plurality of cathode zones are used to control the resistivity uniformity of the plated film across the substrate.

20. The apparatus of claim 15, wherein:

the local flow fields in the plurality of cathode zones are used to control the electromigration resistance uniformity in the plated film across the substrate.

21. A plating apparatus, comprising:

a lower chamber comprising a plurality of anode zones fully isolated by a plurality of insulation shields; wherein each anode zone consists of an independent anode electrolyte circulation and at least one independent gas exit;

an upper chamber comprising a plurality of cathode zones separated by said plurality of insulation shields; wherein the cathode electrolyte circulation within each cathode zone is independently controlled;

a gas bubble collector having pleated channels of v-shaped or inverted v-shaped cross-sections, being placed between the lower chamber and the upper chamber, wherein the gas bubble collector collects bubbles, forces them to coalesce, and guides the coalesced bubble to move out of the apparatus;

a flow dispersing device, being placed at the top of the upper chamber;

a substrate holder, being placed above said flow dispersing device for holding substrate and conducting electrical current to the substrate;

a power supply with a plurality of independently controlled channels;

an electrolyte flow control devices for controlling electrolyte flows within the zones of the chambers;

a plurality of flow distribution sub-system for distributing electrolyte flows into the chambers.

22. The apparatus of claim 21, wherein the gas bubble collector comprising:

one or more frames that supports one or more permeable membranes;

the surface the bubble collector with each anode zone is slanted at angle between 10 to 60 degrees in respect to horizontal plane.

23. The apparatus of claim 22, wherein the permeable membrane closest to the lower chamber is made of one of the following materials: polyvinyl fluoride (PVF), polyvylidene difluoride (PVDF), polytetrafluoroethylene (PTFE), perfluoroalkoxy alkane (PFA), and the pore size is between 2 μm to 50 μm, the permeable membrane closest to the lower chamber separates build-up materials in the lower chamber and the electrolyte above it.

24. The apparatus of claim 22, wherein the permeable membrane closest to the upper chamber is made of one of the following materials: polyvinyl fluoride (PVF), polyvylidene difluoride (PVDF), polytetrafluoroethylene (PTFE), perfluoroalkoxy alkane (PFA), and the pore size is between 2 nm to 150 nm, the permeable membrane closest to the upper chamber filters specific ions in the electrolyte.

25. The apparatus of claim 22, wherein the gas in each anode zone is first collected at the highest location of said bubble collector and is then separately conducted out of the apparatus.

26. The apparatus of claim 22, wherein the gas bubble collector comprising more than one permeable membrane;

a gap is provided between the membranes to form a buffer region; and electrolyte in the buffer region is controlled independently.

27. The apparatus of claim 21, wherein in each anode zone, an anode is fully isolated by one of the insulation shields and is connected to an independently controlled channel of a power supply system.

28. The apparatus of claim 21, wherein:

in each cathode zone, at least one independently controlled electrolyte inlet is provided to control its local flow field.

29. The apparatus of claim 28, wherein:

the local flow fields in the plurality of cathode zones are used to control the mass transport and material exchange of reactants and byproducts near the reacting surface of the substrate.

30. The apparatus of claim 28, wherein:

the local flow fields in the plurality of cathode zones are used to control the compositional uniformity of the plated film across the substrate.

31. The apparatus of claim 28, wherein:

the local flow fields in the plurality of cathode zones are used to control the gapfill performance across the substrate.

32. The apparatus of claim 28, wherein:

the local flow fields in the plurality of cathode zones are used to control the resistivity uniformity of the plated film across the substrate.

33. The apparatus of claim 28, wherein:

the local flow fields in the plurality of cathode zones are used to control the electromigration resistance uniformity in the plated film across the substrate.

* * * * *